US008875406B2

(12) United States Patent
Collard et al.

(10) Patent No.: US 8,875,406 B2
(45) Date of Patent: Nov. 4, 2014

(54) APPARATUS AND METHOD FOR CUTTING TAPE ON A HOCKEY STICK

(76) Inventors: Glen Sheldon Gerald Collard, Newmarket (CA); Robert Michael Skinner, Mississauga (CA)

( * ) Notice: Subject to any disclaimer, the term of this patent is extended or adjusted under 35 U.S.C. 154(b) by 572 days.

(21) Appl. No.: 12/526,128

(22) PCT Filed: Feb. 5, 2008

(86) PCT No.: PCT/CA2008/000240

§ 371 (c)(1), (2), (4) Date: Mar. 22, 2010

(87) PCT Pub. No.: WO2008/095300

PCT Pub. Date: Aug. 14, 2008

(65) Prior Publication Data

US 2010/0275449 A1 Nov. 4, 2010

Related U.S. Application Data

(60) Provisional application No. 60/889,088, filed on Feb. 9, 2007.

(51) Int. Cl.

| | |
|---|---|
| ***B26B 3/00*** | (2006.01) |
| ***B26B 5/00*** | (2006.01) |
| ***B26B 27/00*** | (2006.01) |
| *A63B 49/08* | (2006.01) |
| *A63B 59/00* | (2006.01) |
| *A63B 59/14* | (2006.01) |

(52) U.S. Cl.

CPC ..... *B26B 5/00* (2013.01); *B26B 27/005* (2013.01); *A63B 49/08* (2013.01); *A63B 59/0029* (2013.01); *A63B 59/14* (2013.01)

USPC ..... 30/280; 30/282; 30/285; 30/286; 30/294; 30/314

(58) Field of Classification Search

USPC ..... 30/278, 280, 282–286, 294, 314–317; D8/98

See application file for complete search history.

(56) References Cited

U.S. PATENT DOCUMENTS

| | | | | | |
|---|---|---|---|---|---|
| 2,439,639 | A | * | 4/1948 | Tilly | 30/314 |
| 2,593,601 | A | * | 4/1952 | Pollak | 30/317 |
| 2,610,399 | A | * | 9/1952 | Adams et al. | 30/286 |
| 2,764,814 | A | * | 10/1956 | Jecker | 30/294 |
| 3,230,620 | A | * | 1/1966 | Embleton | 30/286 |
| 3,365,798 | A | * | 1/1968 | Cunningham | 30/314 |
| 3,380,159 | A | * | 4/1968 | Winston | 30/294 |
| 3,571,925 | A | * | 3/1971 | Deutschmann | 30/314 |
| 3,751,806 | A | * | 8/1973 | Patrick | 30/294 |
| 4,026,017 | A | * | 5/1977 | Arnold | 30/283 |
| D269,154 | S | * | 5/1983 | Freedman et al. | D8/98 |
| 4,631,829 | A | * | 12/1986 | Schmidt et al. | 30/294 |
| 4,823,498 | A | * | 4/1989 | Banta | D22/134 |
| 5,341,822 | A | * | 8/1994 | Farr et al. | 30/294 |
| D362,168 | S | * | 9/1995 | Mancini | D8/98 |

(Continued)

*Primary Examiner* — Jason Daniel Prone

(57) ABSTRACT

An apparatus and method for cutting tape on a hockey stick blade is disclosed. The apparatus includes a body for holding the apparatus, a ski including a front edge and a bottom surface, and a cutting blade arranged generally upright relative to the bottom surface of the ski. The cutting blade may include a cutting edge disposed at an acute angle relative to the bottom surface of the ski, the cutting edge positioned proximate to the front edge of the ski.

28 Claims, 7 Drawing Sheets

(56) References Cited

U.S. PATENT DOCUMENTS

| | | | | | |
|---|---|---|---|---|---|
| 5,561,905 | A | * | 10/1996 | Sherman | 30/280 |
| 5,590,471 | A | * | 1/1997 | Wiezenthal | 30/294 |
| 5,638,603 | A | * | 6/1997 | Li | 30/280 |
| 5,737,842 | A | * | 4/1998 | Freedman | 30/280 |
| D514,916 | S | * | 2/2006 | Craig | D8/102 |
| D574,210 | S | * | 8/2008 | Packard et al. | D8/98 |
| 7,818,885 | B2 | * | 10/2010 | Lafauci et al. | 30/294 |
| D637,883 | S | * | 5/2011 | Yu Chen | D8/98 |
| 8,006,390 | B2 | * | 8/2011 | Mueller et al. | 30/294 |
| 8,171,647 | B2 | * | 5/2012 | Gullicks et al. | 30/294 |
| 8,176,640 | B2 | * | 5/2012 | Gullicks et al. | 30/294 |
| 2002/0069733 | A1 | * | 6/2002 | Allenberg et al. | 30/294 |
| 2007/0044322 | A1 | * | 3/2007 | Trbovich et al. | 30/294 |
| 2008/0168665 | A1 | * | 7/2008 | Chiang | 30/286 |
| 2011/0010866 | A1 | * | 1/2011 | Green et al. | 7/118 |

* cited by examiner

APPARATUS AND METHOD FOR CUTTING TAPE ON A HOCKEY STICK

PRIORITY

For the United States of America, this application claims the benefit under 35 USC 119(e) of U.S. patent application Ser. No. 60/889,088, filed Feb. 9, 2007, the entirety of which is incorporated herein by this reference to it.

FIELD

This specification relates to cutting tools. This specification also relates to equipment for the sport of ice hockey.

BACKGROUND

The comments in this background section are not an admission that anything discussed in this section is citable as prior art or part of the common general knowledge of persons skilled in the art in any country.

Hockey players may wrap the blade of their stick with adhesive tape. The tape may be applied to the blade of the stick to improve friction between the puck and the stick for better control and to cushion the reaction to the puck when it strikes the blade of the stick, thereby improving the puck-handling characteristics of the stick.

To apply the tape, the player wraps tape around the blade, beginning at one end, running the tape at a light angle after the first wrap to create an overlap, e.g., of about ¼". The player may press the tape as flat as possible against the blade to maximize puck control, ensuring that there are no bubbles or excess tape. Tape may be applied in either direction, heel to toe or toe to heel. Each player may have his/her own preference. However, applying tape from heel to toe may reduce the friction of the snow on the ice, reducing the build-up of the snow on the blade. Applying tape from heel to toe may also allow greater spin when passing and shooting.

Hockey tape may be replaced by the player, for example at regular intervals, once the tape begins to wear-out or when its adhesion is impaired. Removing hockey tape from a stick may be a considerable nuisance. An accepted practice for tape removal is a "brute force" method: the player uses his/her fingers to tear, pull and/or unwind the tape away from the blade. This may become increasingly more difficult over time, as the tape becomes compressed on to the blade as a result of impacts with the hockey puck, or where it has been cut due to contact with a skate blade or other objects, causing the tape to come off in pieces.

The use of a knife or a straight razor is another approach to tape removal, but doing so may risk scoring or otherwise damaging the blade, and thus this method is generally avoided. Also, slitting the tape with a knife or razor may not necessarily make it that much easier to remove the tape as one would still have to use the blade of the knife, or a fingernail, to lift the tape along the edge that it has been cut in order to get a sufficient grip to then pull the tape off of the blade.

Preventing damage to the blade may be important in light of the new generation of hockey sticks made of Aluminum, fiberglass, and composite materials that have become more and more common for players of all levels of ability. These sticks may be expensive, and so users are less inclined to jeopardize the integrity of the blade using a cutting tool to remove the tape.

INTRODUCTION

The following is intended to introduce the reader to this specification but not to define or limit any claim. Inventions may reside in a combination or sub-combinations of the apparatus elements or process steps described below or in other parts of this document.

An apparatus is provided for cutting tape on a hockey stick blade. The apparatus includes a body, and a ski including a front edge and a bottom surface. The apparatus includes a cutting blade arranged generally upright relative to the bottom surface of the ski. The cutting blade may include a cutting edge disposed at an acute angle relative to the top surface of the ski, and the cutting edge may be positioned proximate to the front edge of the ski.

There is also provided a method of cutting tape on a hockey stick blade, the method including providing an apparatus as described herein, gripping the body of the apparatus, guiding the front edge of the ski to an edge of the tape, and pushing and directing the front edge of the ski between the tape and the hockey stick blade so that the tape engages the cutting edge of the cutting blade thereby cutting the tape.

DETAILED DESCRIPTION

Various apparatuses or methods will be described below to provide an example of an embodiment of each claimed invention. No embodiment described below limits any claimed invention and any claimed invention may cover apparatuses or methods that are not described below. The claimed inventions are not limited to apparatuses or methods having all of the features of any one apparatus or method described below or to features common to multiple or all of the apparatuses described below. It is possible that an apparatus or method described below is not an embodiment of any claimed invention. The applicant(s), inventor(s) and/or owner(s) reserve all rights in any invention disclosed in an apparatus or method described below that is not claimed in this document and do not abandon, disclaim or dedicate to the public any such invention by its disclosure in this document.

Because of the sticky and elastic nature of hockey tape, normal use of a taped hockey stick blade over time may cause the tape to be compressed and adhered to the blade, making removal difficult. This may be especially true for the inside curvature of the hockey blade, where the tape is impacted onto the blade after repeated collisions with a hockey puck.

To address this problem, an apparatus is provided including a body for holding the apparatus, and a ski. The ski generally includes a front edge and a bottom surface. The apparatus also includes a cutting blade arranged generally upright relative to the bottom surface of the ski. The cutting blade includes a cutting edge disposed at an acute angle relative to the bottom surface of the ski. The cutting edge is positioned proximate to the front edge of the ski.

In use, the ski of the apparatus is forced between the tape and the hockey stick blade. The ski lifts the tape, making it taut and easier to cut while also protecting the hockey stick blade from the cutting blade.

The apparatus and method described herein is simple, effective, and enables the removal of tape from a hockey stick blade without scoring or otherwise damaging the blade by lifting the tape, cutting the tape and turning up both sides of the cut to allow the user to grip the tape and remove the tape from the blade of the stick.

Figure 1:
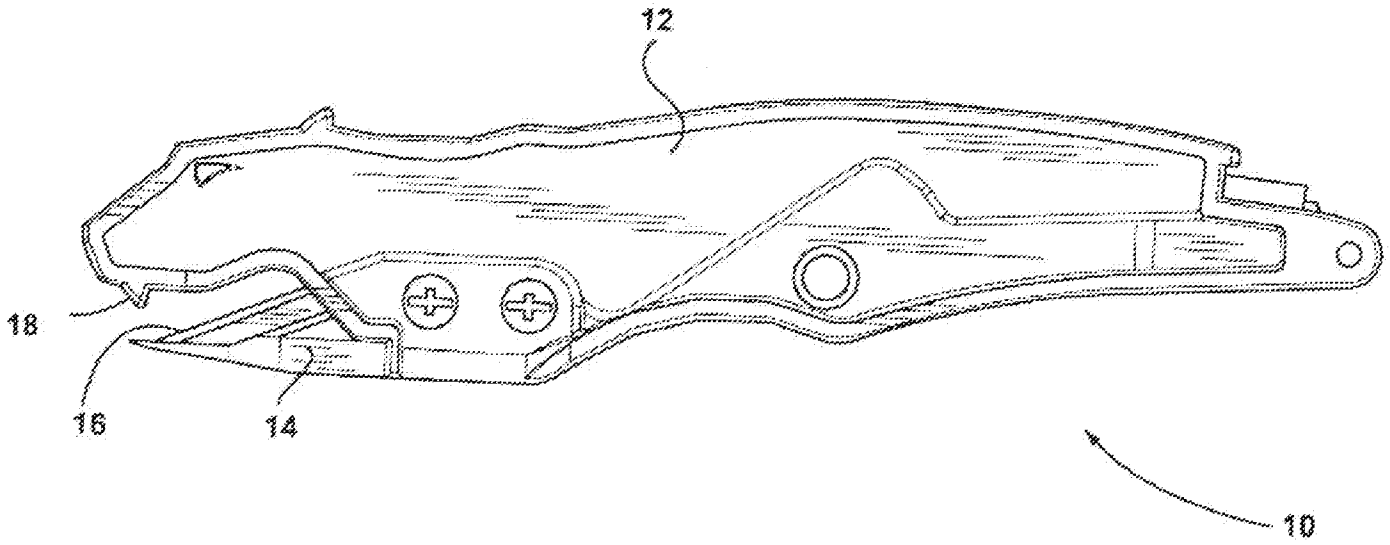
FIG. 1 illustrates a side view of a cutting apparatus.

With reference to FIG. 1, an example of a cutting apparatus 10 includes a body 12 and a ski 14. Preferably, the body 12 is adapted to fit comfortably in a user's hand, and may have a longitudinal extent that is generally parallel with a direction of cutting. The body 12 may also be offset at an angle in relation to the ski 14, thereby providing a natural angle of attack when in use.

The body 12 may be formed of a sufficiently tough and durable material so that the apparatus 10 is robust and resistant to breaking, cracking or chipping after repeated use, dropping, etc. For example, the body 12 may be formed of a plastic material, such as nylon. In another example, the body 12 may be formed of a composite material, such as fiberglass reinforced nylon.

The apparatus 10 further comprises a cutting blade 16. To ensure efficient cutting, the blade 16 should be sharp. To prevent operators, who may be children, from injuring themselves by coming in to contact with the cutting blade 16, the body 12 may include a blade covering portion 18 extending longitudinally beyond the front edge of the ski 14. The blade covering portion 18 provides a means of covering and protecting the blade 16, since a gap between the blade covering portion 18 and the ski 14 is relatively narrow so that it is not possible for even a small finger to touch the blade 16.

In operation, the ski 14, once slid between the tape and the hockey stick blade, serves to lift the tape thereby making the tape taut, and therefore easier to cut, prior to engagement with the angled cutting blade 16. The cutting blade 16 is provided at an angle in relation to the bottom surface of the ski 14, as discussed more fully below.

Figure 2:
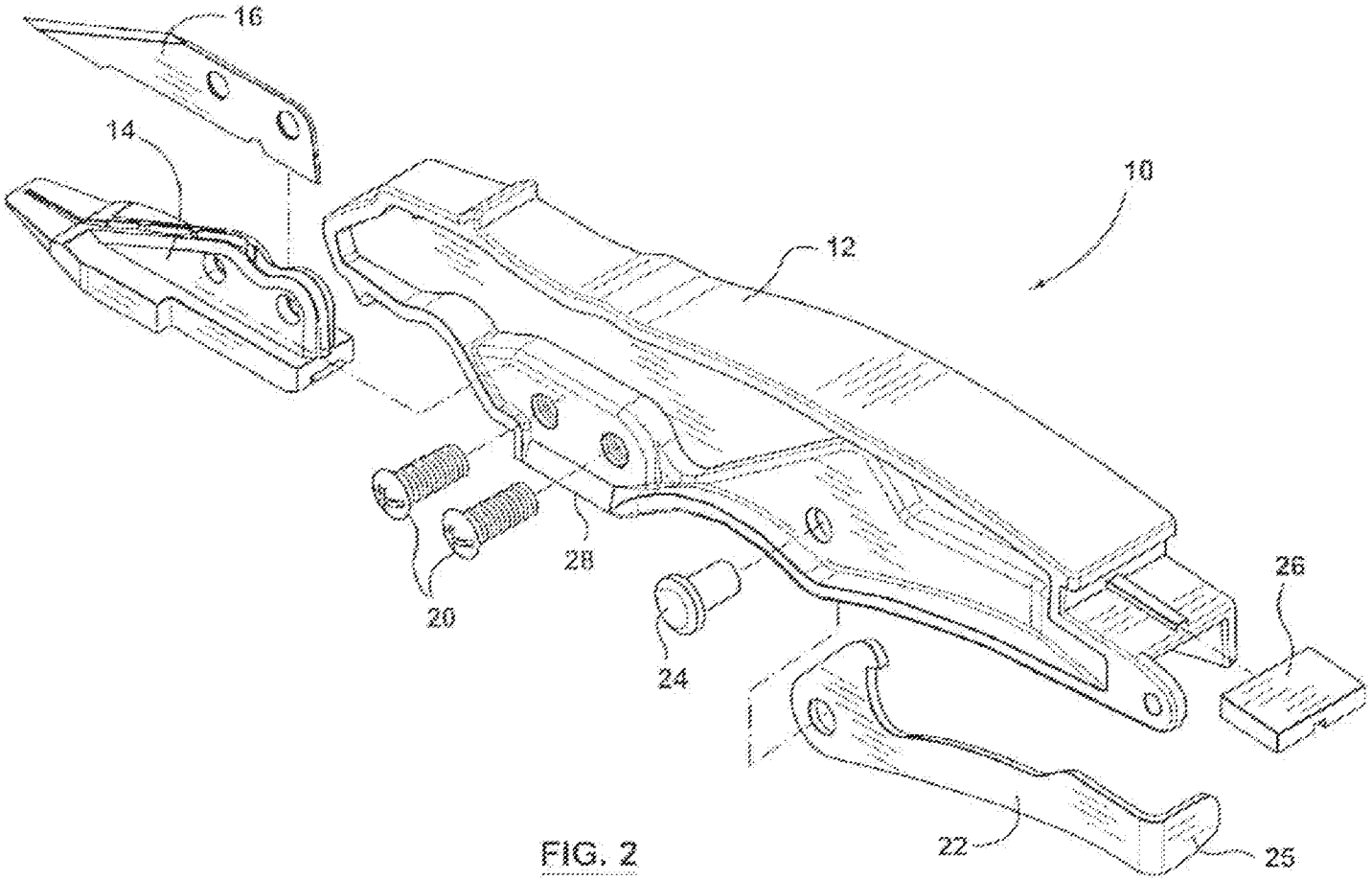
FIG. 2 illustrates an exploded view of the apparatus shown in FIG. 1.

With reference to FIG. 2, the ski 14 and the cutting blade 16 are fixed to the body 12 by a fastening means 20, such as one or more bolts or screws. In one particular configuration, the fastening means 20 could include a bolt and wing nut or similar hand releasable fastening mechanism (not shown), advantageously allowing the user to replace the cutting blade 16 without the use of tools.

The apparatus 10 may further include a bottle opener and/or lace tightening device 22, which is held to the body 12 via a fastening means 24 such as a screw or a rivet. The bottle opener and/or lace tightening device 22 may also include a flat tip 25 that can be used as a flathead screwdriver for repairing helmets, etc. The apparatus 10 may further include a skate sharpening stone 26. The bottle opener and/or lace tightening device 22 and the skate sharpening stone 26 are optional components. Also optional is the inclusion of a relatively sharp edge 28 at some point on the main body 12 to assist the user in the removal of remaining tape residue left on the stick's blade after the tape has been removed. Other optional components could be included.

Figure 3:
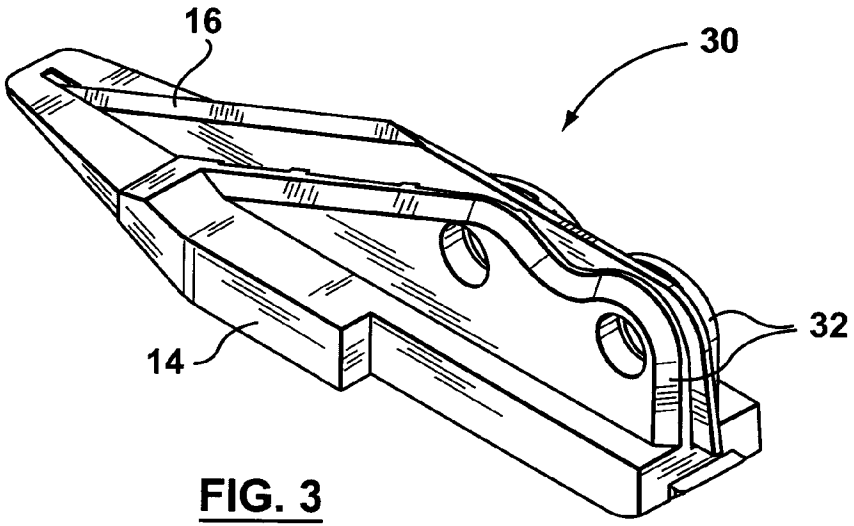
FIG. 3 illustrates an elevated view of a portion of the apparatus shown in FIG. 1, namely a ski and a cutting blade.
Figure 4:
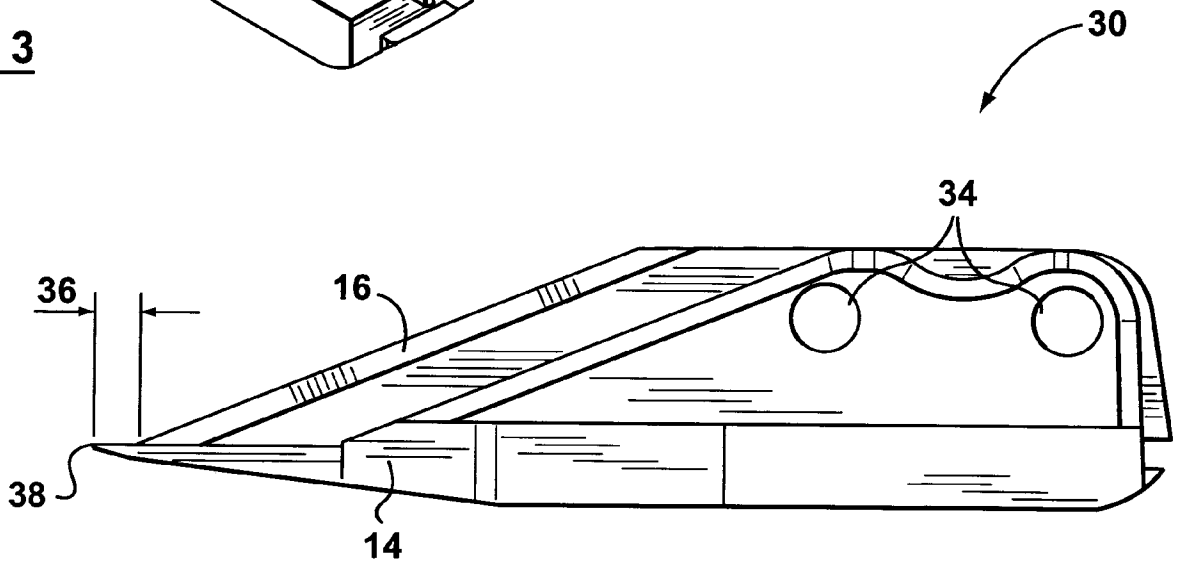
FIG. 4 illustrates a side view of a portion of the apparatus shown in FIG. 1, namely a ski and a cutting blade.

With reference to FIGS. 3 and 4, according to the specific example illustrated, the ski 14 and the cutting blade 16 may together comprise a cutting assembly 30. The ski 14 may include sidewalls 32, the sidewalls 32 forming a slot that fittingly engages the cutting blade 16. The sidewalls 32 may also include apertures 34 for receiving the fastening means 20 for fixing the ski 14 and the cutting blade 16 to the body 12. The fastening means 20 allows the cutting blade 16 to be removed and replaced when necessary, i.e. when the blade is worn out.

It is not essential that the cutting blade 16 be housed in the ski 14.

The cutting blade 16 may be arranged or fixed generally upright (e.g., it may be perpendicular, but does not have to be exactly perpendicular) relative to a bottom surface of the ski 14. The cutting blade 16 may also be arranged or fixed centrally and longitudinally (i.e. in a direction generally parallel to a general cutting direction) in relation to a top surface 59 of the ski 14. Suitable configurations of the cutting blade 16 relative to the ski 14 may be accomplished in a multitude of ways as would be appreciated by a person of skill in the art. For example, the cutting blade 16 could be welded to the ski 14. A welded configuration would operate as a cutting device in much the same way. However, a drawback to this approach is that it would not be possible to replace the cutting blade 16 independently of the ski 14.

With reference to the cutting assembly 30 illustrated in FIG. 4, the tip of the cutting blade 16 may be offset a distance 36 from a front edge or tip 38 of the ski 14. The distance 36 allows for the ski 14 to lift and pull the tape away from the hockey stick before contacting the blade 16 making it easier to cut.

It has been determined that apparatus 10 is most effective at cutting when the distance 36 does not exceed a certain threshold. In particular, the distance 36 of offset should be less than about 4.5 mm, or about 0.5 to 5 mm, or about 1 to 3 mm. With a distance greater than 5 mm, there may be too much surface area of the ski 14 to impede the adhesive tape, causing gathering of the tape and preventing efficient cutting. Hockey tape is generally relatively strong, sticky and elastic. The inventors have found that the longer the distance 36 means that greater force is required to push the ski 14 under the tape and lift the tape. As well, due to the tape's material and elasticity it will begin to gather as it is being pushed, and the gathering makes it difficult, and at a certain point the blade 16 will not be able to cut the tape with reasonable force.

Figure 5:
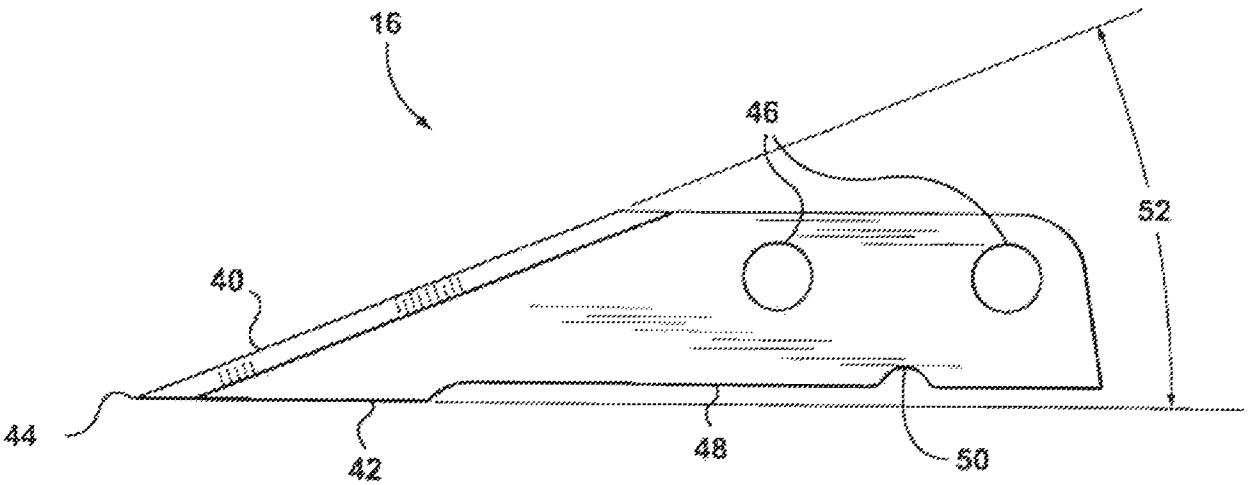
FIG. 5 illustrates a side view of a portion of the apparatus shown in FIG. 1, namely a cutting blade.

With reference to FIG. 5, the cutting blade 16 comprises a cutting edge 40, a bottom edge 42 and a tip 44 formed by the cutting and bottom edges 40, 42. The cutting blade 16 may also include apertures 46 corresponding to the apertures 34 of the ski 14. The apertures 34, 46 receive the fastening means 20. The bottom edge 42 of the cutting blade 16 may include a cut away portion 48 including a notch 50. The slot formed by the sidewalls 32 of the ski may include a bottom profile including a knob (not shown) complementary to the notch 50. When the cutting blade 16 is seated in the ski 14, the knob/notch 50 configuration ensures that the cutting blade 16 is positioned correctly and is held firmly in place.

The cutting blade 16 is preferably angled. An angled cutting blade 16 has been found to be effective at cutting because it forces the tape further up and away from the hockey stick blade, pulling it tight and allowing the cutting edge 40 to cut though. The inventors have found that the apparatus 10 has superior cutting performance when the blade angle 52 (defined by the angle between the cutting edge 40 and the bottom edge 42 in the configuration illustrated) is generally between about 10 to 22.5 degrees, or about 10 to 25 degrees, or about 18 to 23 degrees. With an angle of about 22.5 degrees, for example, it has been found that the cutting edge 40 slices through the tape relatively quickly. With a higher angle greater than 25 degrees, it has been found that tape tends to stretch more and bunch up, and the tape will not be able to be cut with reasonable force.

The cutting blade 16 may be formed from a metallic material such as steel or aluminum. In a particular example, the cutting blade 16 may be formed of a high performance stainless steel material, such as SK5 steel.

Figure 6:
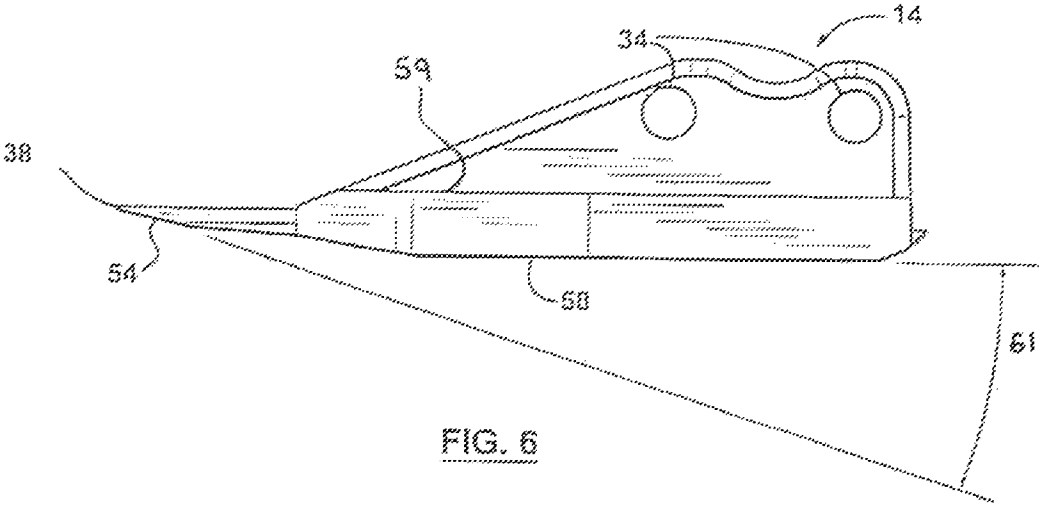
FIG. 6 illustrates a side view of a portion of the apparatus shown in FIG. 1, namely a ski.

With reference to FIG. 6, the ski 14 may include beveling on the bottom surface of the ski 14. In particular, the ski may include a bevel portion 54 and a relatively flat bottom surface 58. Preferably, the bevel portion 54 generally engages the hockey stick blade during cutting (curvature of the hockey stick blade may prevent the entire bevel portion 54 from engaging the hockey stick blade). A bevel angle 61 of the bevel portion 54 creates the angle of attack with which the apparatus 10 is applied to the hockey stick blade, and may provide feedback to the user to allow the user to attain and maintain the correct angle during use. An effective bevel angle 61 has been found to be about 10 to 20 degrees, or about 7 to 17 degrees, or about 9 to 12 degrees.

It is preferable that at least the bevel portion 54 is relatively flat across its width (i.e. neither concave or convex in a lateral direction relative to the direction of cutting), so that the bevel portion 54 may sit flush with the surface of the hockey stick blade to get underneath the edge of the hockey tape.

For the sake of comparison, the inventors conducted tests using a ski having a flat bottom in the longitudinal direction, i.e. in the direction of cutting. The result was that, due to the blade of the stick being curved, the tip of the ski would dig into the blade of the stick and stop or score the stick blade. Tests were also conducted with a ski bottom that was concave in shape in a lateral direction. A ski that was concaved from side to side was problematic because the center of the tip of the ski was then not flat on the blade of the stick, and therefore would not easily go under the tape.

The front edge 38 of the ski 41 should be sufficiently sharp and narrow in order to get underneath the edge of the hockey tape. For example, the front edge 38 of the ski 14 may have a thickness of about 0.1 to 0.5 mm. Or, for example, the front edge 38 of the ski 14 may have a thickness of about 0.2 to 0.3 mm. The width of the tip 38 should be thin enough and relatively narrow so it may slip under the tape, but wide enough to stretch the tape to enable efficient cutting. The gradual increase in the width of the ski 14 (across the bevel portion 54) pulls the tape taut for cutting and also turns the edges of the tape up away from the stick blade so the user can easily grab the edges of the tape and peel back the tape off the stick blade.

Because the front edge of the ski 14 is applied, at an angle of attack, to the edge of the tape with sufficient force to slide between the tape and the hockey stick blade, and the tip 38 of the ski should be sufficiently thin, it is important that at least the portion around the tip 38 of the ski 14 be formed from a sufficiently tough material, for example, a metallic material. In a particular example, stainless steel may be used. Other tough materials may be possible, but the inventors have found that even hard plastics, such as polycarbonate, may not be suitable for the ski 14 because they are prone to break, crack or chip after repeated use when produced in accordance with the dimensional parameters described herein.

Figure 7:
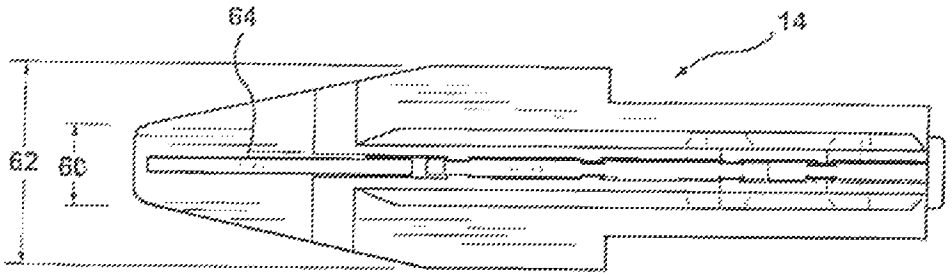
FIG. 7 illustrates a top view of a portion of the apparatus shown in FIG. 1, namely a ski.

With reference to FIG. 7, the front width 60 of the ski 14 may be about 5 to 7 mm, or 3 to 8 mm, or 4 to 5 mm, for example. The ski 14 may optionally be flared in a direction away from the front edge 38, providing a further means of lifting the tape up and of the blade during cutting. For example, the ski can have a flare width 62 of about 10 to 13 mm, or 8 to 14 mm, or about 10 to 12 mm. Or, for example, the ski member 14 may flare away from the tip 38 at an angle of about 10 to 30 degrees on both sides. A tip with 60 that is too wide results in excessive resistance to the cutting operation, while a tip width 60 that is too narrow results in an insufficient bearing surface to spread the applied load to the blade of the hockey stick which can cause the apparatus 10 to scratch or otherwise damage the blade of the hockey stick.

The ski 14 may further include a recess 64 for receiving the bottom surface 42 of the cutting blade 16 so that the tip 44 of the cutting blade 16 is provided in a recessed position relative to a top surface of the ski 14. Providing the tip 44 in a recessed position inhibits the possibility of tape catching at the tip 44 between the ski 14 and the cutting blade 16, which would negatively affect the cutting process.

The apparatus 10 is relatively simple and intuitive to use. The front edge of the ski 14 may be guided to an edge of the tape at an end of the hockey stick blade, and then directed between the tape and the hockey stick blade, such that the tape engages the cutting edge 40 of the cutting blade 16 thereby cutting the tape. The user slides apparatus 10 though the length of the blade of the stick, thereby cutting the tape and allowing easy removal.

In practice, it has been found that tape removal is easier if the user begins cutting the tape at the heel end of the blade, preferably in the same direction the stick blade was taped, along the inside curvature of the stick blade. It is preferable if the ski is forced between the blade and the tape at a midway point on the blade surface (midway in a height direction, not a heel-toe direction), and may be easier and safer if the cutting is done with a pushing action away from the user's body, as opposed to pulling the apparatus 10. For this reason, the body 12 is preferably located generally behind (from the perspective of the user) the ski 14 and blade 16. The inventors have attempted other configurations for use with a pulling motion. However, problems arose with these configurations. First, while pulling such an apparatus, the body portion tended to hide the tip of the ski from view of the operator, and made it difficult to place the ski under the edge of the tape and maintain the correct angle to cut the tape. Second, a pulling action was found to be potentially dangerous since the operators would be pulling the blades towards their bodies with some degree of force.

As mentioned above, the body 12 is adapted to fit comfortably in a user's hand, and may be offset at an angle in relation to the bottom surface 58 of the ski 14, thereby providing an angle of attack when in use. The angle of the body 12 also allows the user's fingers to be located under the body 12 when holding the device and still have clearance relative to the stick, preventing the fingers from contacting the stick blade and tape.

Because the ski 14 may have a substantially flat bottom surface (e.g., at least over the bevel portion 54), use of the apparatus 10 advantageously prevents damage or scoring of the blade, as compared with trying to remove the tape with a straight razor or a knife, for example.

Although the body 12, ski 14 and cutting blade 16 are illustrated as separate components, the apparatus 10 could comprise a unitary design wherein two or more components are integrated in a unitary design. For example, the ski 14 may be integrated with the body 12 as a single molded assembly, or the blade 16 could be integrated with the ski 14 as a single unitary assembly, or both. Another possible configuration is integrate the cutting blade 14 with the body 12, e.g., by insert molding the cutting blade 14 into the body 12. Other configurations are of course possible.

Figure 8:
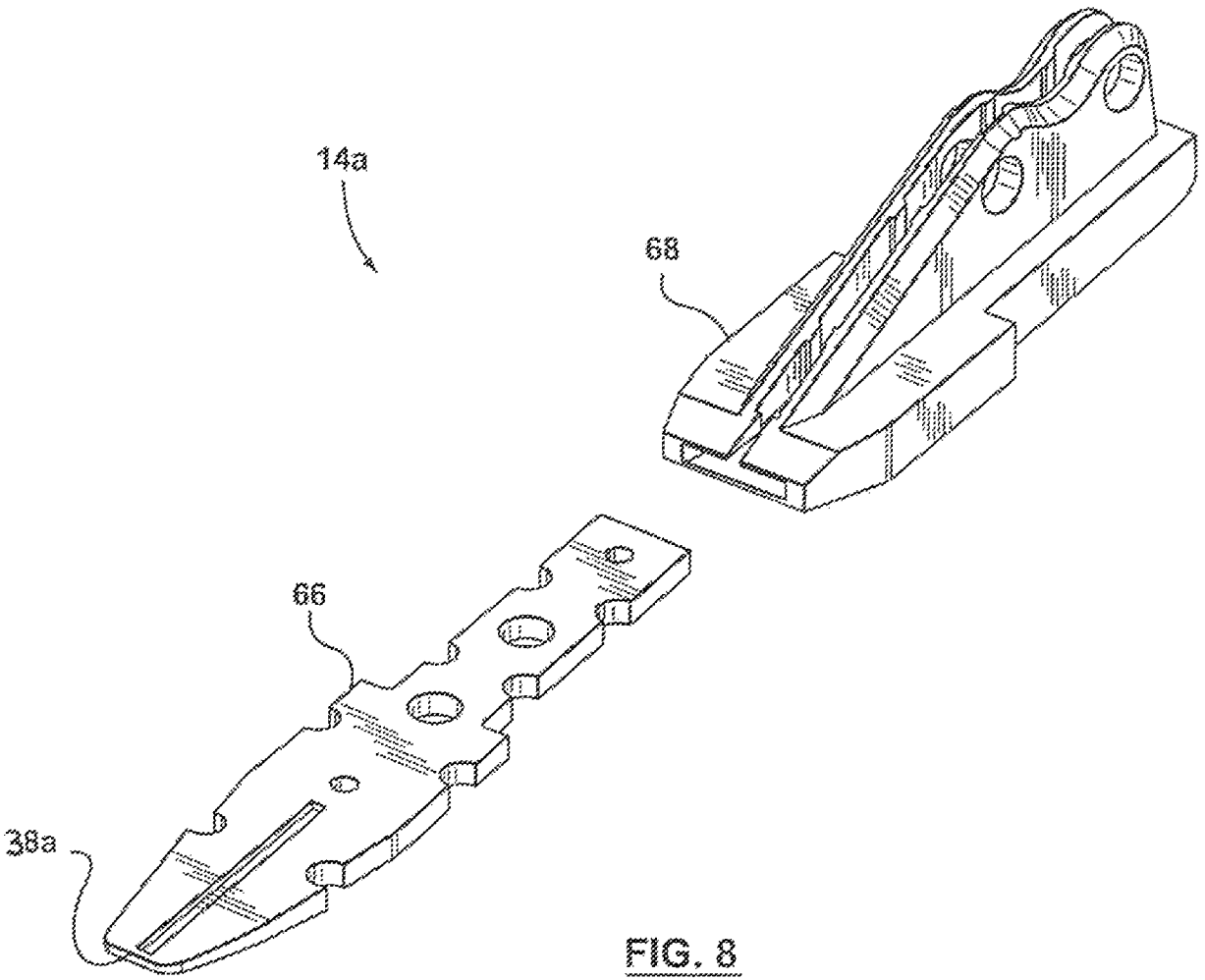
FIG. 8 illustrates an elevated view of a two-piece ski.

It is also possible for one or more components be fabricated from more than one material. With reference to FIG. 8, an example of a ski 14*a* is shown having a first portion 66 and a second portion 68. The second portion 68 is configured to securely retain the first portion. The first portion 66 includes the tip 38*a* and can be fabricated with a hard, tough metallic material, such as stainless steel. The second portion 68 including the remainder of the ski 14*a* can be fabricated with another, preferably less expensive and easily fabricated material, such as nylon.

Figure 9A:
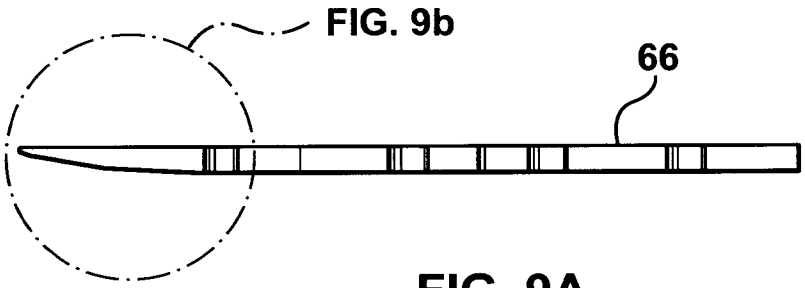
FIGS. 9A and 9B illustrate side views of a portion of the ski shown in FIG. 8.
Figure 9B:
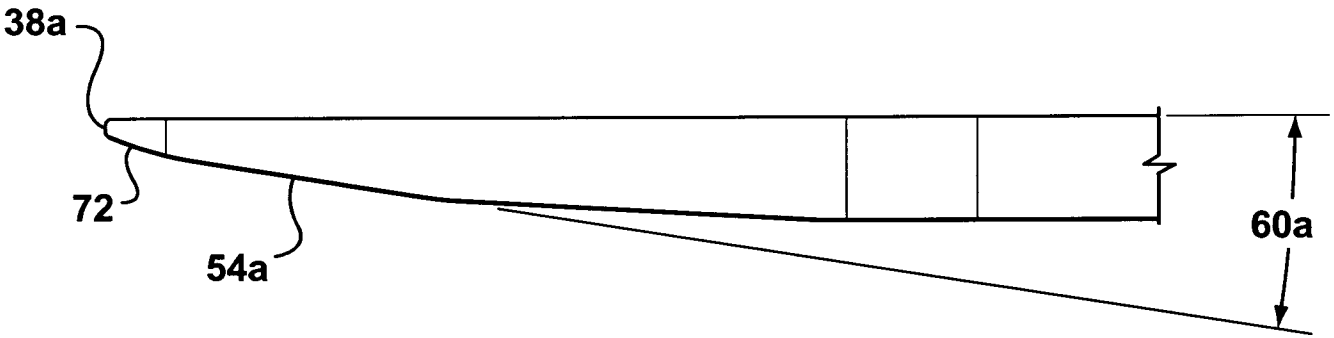

With reference to FIGS. 9A and 9B, the first portion 66 of the ski 14*a* may have a rounded bottom surface including bevel portion 54*a*. A bevel angle 60*a* may be roughly equivalent to the bevel angle 61 for ski 14, namely about 7 to 17 degrees, or about 9 to 12 degrees. As illustrated, the bevel portion 54*a* need not be immediately adjacent to the tip 38*a* of the ski 14*a*, but may be proximate to the front edge 38*a* of the ski 14*a*, less than about 3 mm away or about 1 to 2 mm away. The portion 72 between the bevel portion 54*a* and the front edge 38*a* may be rounded enabling a user, once the tip 38*a* has been placed underneath the edge of the hockey tape, to rock the apparatus to generally engage the bevel portion 54*a* with the hockey stick blade.

It is anticipated that those having ordinary skill in this art can make various modification to the apparatuses and methods disclosed herein to produce modified apparatuses and methods that fall within the scope of the present invention as defined by the following claims.

We claim:

1. A cutting tool comprising:

a body with a covering projection and at least one attachment hole;

a ski with a rear portion and a front portion, the rear portion has a substantially flat bottom surface, two flared sides, and two walls each with at least one aperture, wherein the two walls each extend in a direction away from the bottom surface and define a space therebetween, the front portion has a bottom surface with an inner bevel and an outer bevel different from the inner bevel, a substantially flat upper portion that along with the outer bevel define a sharp tip, a recess in the substantially flat upper portion spaced from the sharp tip, and two tapered sides wherein a width of the sharp tip is smaller than a width of a remaining portion of the ski;

an elongated blade with an oblique cutting edge and at least one aperture;

wherein the blade is received by the spaced defined by the two walls and the recess in the substantially flat upper portion of the ski in such a way that the blade is spaced from the sharp tip and the at least one aperture of the blade is aligned with the at least one aperture of the ski; and at least one removable connector extending through the at least one apertures of the ski and the blade and the at least one hole of the body to allow for the ski and the blade to be removably connected to the body in such a way that the covering projection and the substantially flat upper portion define a gap that exposes a portion of the oblique cutting edge to engage a work piece.

2. The cutting tool of claim 1 further comprising the body is made of a plastic material.

3. The cutting tool of claim 2 the plastic material is fiberglass reinforced nylon.

4. The cutting tool of claim 1 further comprising the covering portion of the body extends longitudinally beyond the exposed portion of the cutting edge.

5. The cutting tool of claim 1 further comprising a bottle opener connected to the body.

6. The cutting tool of claim 5 the bottle opening further comprises a screwdriver flat tip.

7. The cutting tool of claim 1 further comprising a tightening device connected to the body.

8. The cutting tool of claim 7 the tightening device further comprises a screwdriver flat tip.

9. The cutting tool of claim 1 further comprising a sharpening stone on the body.

10. The cutting tool of claim 1 the body further comprises a sharp scraper edge.

11. The cutting tool of claim 1 the space between the sharp tip and the blade is less than about 4.5 mm.

12. The cutting tool of claim 1 the space between the sharp tip and the blade is less than about 0.5 mm to 5 mm.

13. The cutting tool of claim 1 the space between the sharp tip and the blade is less than about 1 mm to 3 mm.

14. The cutting tool of claim 1 the blade has a substantially flat lower surface and the oblique cutting edge and the substantially flat lower surface define an angle.

15. The cutting tool of claim 14 the angle is about 10° to 22.5°.

16. The cutting tool of claim 14 the angle is about 10° to 25°.

17. The cutting tool of claim 14 the angle is about 18° to 23°.

18. The cutting tool of claim 1 the blade is made from one of steel or aluminum.

19. The cutting tool of claim 18 the steel is SK5 steel.

20. The cutting tool of claim 1 the outer bevel of the ski front portion and the substantially flat bottom surface of the ski rear portion define an angle of about 10° to 20°.

21. The cutting tool of claim 1 the outer bevel of the ski front portion and the substantially flat bottom surface of the ski rear portion define an angle of about 7° to 17°.

22. The cutting tool of claim 1 the outer bevel of the ski front portion and the substantially flat bottom surface of the ski rear portion define an angle of about 9° to 12°.

23. The cutting tool of claim 1 the ski is made of stainless steel.

24. The cutting tool of claim 1 the width of the sharp tip is about 5 mm to 7 mm.

25. The cutting tool of claim 1 the width of the sharp tip is about 3 mm to 8 mm.

26. The cutting tool of claim 1 the width of the sharp tip is about 4 mm to 5 mm.

27. A method of cutting tape on a hockey stick blade utilizing the tool of claim 1, the method comprising:

pushing and directing the sharp tip between the tape and the hockey stick blade so that the outer bevel of the front portion engages the hockey stick blade and the tape travels into the gap and engages the exposed portion of the cutting edge thereby cutting the tape.

28. A method of cutting tape on a curved hockey stick blade utilizing the tool of claim 1, the method comprising:

pushing and directing the sharp tip between the tape and the hockey stick blade so that the outer bevel of the front portion engages an inside portion of the blade curve so that the tape travels into the gap and engages the exposed portion of the cutting edge thereby cutting the tape.

* * * * *